US012163407B2

(12) United States Patent
Bridges et al.

(10) Patent No.: US 12,163,407 B2
(45) Date of Patent: Dec. 10, 2024

(54) WELL PRODUCTION MANIFOLD FOR LIQUID ASSISTED GAS LIFT APPLICATIONS

(71) Applicant: LIFT IP ETC, LLC, Denison, TX (US)

(72) Inventors: Timothy Jay Bridges, Denison, TX (US); Scott James Bridges, Denison, TX (US)

(73) Assignee: LIFT IP ETC., LLC, Denison, TX (US)

( * ) Notice: Subject to any disclaimer, the term of this patent is extended or adjusted under 35 U.S.C. 154(b) by 0 days.

(21) Appl. No.: 18/097,098

(22) Filed: Jan. 13, 2023

(65) Prior Publication Data

US 2023/0243245 A1 Aug. 3, 2023

Related U.S. Application Data

(60) Provisional application No. 63/299,277, filed on Jan. 13, 2022.

(51) Int. Cl.
*E21B 43/12* (2006.01)
*E21B 47/06* (2012.01)

(52) U.S. Cl.
CPC ..... *E21B 43/123* (2013.01); *E21B 43/122* (2013.01); *E21B 47/06* (2013.01)

(58) Field of Classification Search
CPC ..... E21B 43/122; E21B 43/13; E21B 47/06
See application file for complete search history.

(56) References Cited

U.S. PATENT DOCUMENTS

| | | | | |
|---|---|---|---|---|
| 3,863,717 | A | 2/1975 | Cooper | |
| 3,899,027 | A | 8/1975 | Jenkins | |
| 4,500,263 | A | 2/1985 | Mohn | |
| 4,529,037 | A | 7/1985 | Froning et al. | |
| 4,711,306 | A | 12/1987 | Bobo | |
| 6,039,116 | A | 3/2000 | Stevenson et al. | |
| 6,325,147 | B1 | 12/2001 | Doerler et al. | |
| 7,114,557 | B2 | 10/2006 | Cudmore et al. | |
| 8,109,158 | B2 * | 2/2012 | Guieze ..... | G01N 1/2035 73/864 |
| 8,371,390 | B2 | 2/2013 | Quinlan | |
| 8,408,289 | B2 | 4/2013 | Loree | |

(Continued)

OTHER PUBLICATIONS

Brill, J. P. and Mukherjee, H. "Multiphase Flow in Wells", Society of Petroleum Engineers, SPE Monograph Series, vol. 17 pp. 1-149 (1999).

(Continued)

*Primary Examiner* — Catherine Loikith
(74) *Attorney, Agent, or Firm* — Shook, Hardy & Bacon L.L.P.

(57) ABSTRACT

A system comprises a plurality of manifolds configured to combine a liquid and a gas into liquid-gas mixtures and deliver the liquid-gas mixtures to wells to facilitate product flow. Different manifolds of the plurality of manifolds operate on different parameters—e.g., produce liquid-gas mixtures having different compositions of liquid and gas—based on characteristics of the respective well associated with the respective manifold. An external liquid pump and/or gas compressor delivers liquid and/or gas to each manifold of the plurality of manifolds.

20 Claims, 7 Drawing Sheets

(56) References Cited

U.S. PATENT DOCUMENTS

| | | | | |
|---|---|---|---|---|
| 9,127,655 | B2 * | 9/2015 | Wang | F04B 15/08 |
| 2001/0040033 | A1 | 11/2001 | Schnatzmeyer et al. | |
| 2005/0173114 | A1 | 8/2005 | Cudmore et al. | |
| 2006/0162922 | A1 | 7/2006 | Chung et al. | |
| 2006/0196674 | A1 | 9/2006 | Butler et al. | |
| 2007/0068672 | A1 | 3/2007 | Jalali et al. | |
| 2007/0199705 | A1 | 8/2007 | Hocking | |
| 2007/0204991 | A1 | 9/2007 | Loree et al. | |
| 2008/0257556 | A1 | 10/2008 | Kippie et al. | |
| 2013/0153218 | A1 | 6/2013 | Boone | |
| 2013/0292122 | A1 | 11/2013 | Nichols et al. | |
| 2016/0230513 | A1 | 8/2016 | Dykstra et al. | |
| 2019/0063216 | A1 | 2/2019 | Bouldin et al. | |
| 2019/0277119 | A1 * | 9/2019 | Campion | E21B 43/122 |
| 2020/0263525 | A1 | 8/2020 | Reid et al. | |
| 2021/0032965 | A1 | 2/2021 | Bridges et al. | |
| 2021/0404606 | A1 * | 12/2021 | Guan | F17D 3/01 |

OTHER PUBLICATIONS

Coleman, S. B. et al. "A New Look at Prediction Gas-Well Load-Up", Journal of Petroleum Technology, pp. 329-333 (Mar. 1991).

Shobham, O. "Mechanistic Modeling of GasLiquid Two-Phase Flow in Pipes", Society of Petroleum Engineers, pp. 1-29 (2006).

Turner, R. G. "Analysis and Prediction of Minimum Flow Rate for the Continuous Removal of Liquids from Gas Wells", Journal of Petroleum Technology, pp. 1475-1482 (Nov. 1969).

Unknown, "Recommended Practices for Operation, Maintenance, Surveillance, and Troubleshooting of Gas-lift Installations," American Petroleum Institute, pp. 138 (Mar. 2015).

Non-Final Office Action dated Jun. 14, 2022 in U.S. Appl. No. 17/047,312, 16 pages.

Non-Final Office Action dated Sep. 17, 2021 in U.S. Appl. No. 17/047,312, 13 pages.

* cited by examiner

WELL PRODUCTION MANIFOLD FOR LIQUID ASSISTED GAS LIFT APPLICATIONS

CROSS-REFERENCE TO RELATED APPLICATIONS

This application claims the benefit of U.S. Provisional Application 63/299,277, filed Jan. 13, 2022, and entitled "An Intelligent Well Production Manifold Used in Liquid Assisted Gas Lift Applications on Centralized Fields or Pads." The entirety of the aforementioned application is incorporated by reference herein.

FIELD OF INVENTION

The present invention generally relates to systems and processes for liquid-assisted gas lift ("LAGL") across a plurality of wells.

BACKGROUND OF INVENTION

Most oil and gas wells produce the product using the pressure created by the earth's layers. At a point in the well's life, this formation pressure decreases as a result of the product exiting the well bore to the surface. When the formation pressure is so low that it will not lift the product to the surface, artificial lift is used to extract the remaining product from the well.

Previous artificial lift processes have relied upon downhole equipment (e.g., equipment installed deep into the well bore). Because wells do not produce clean product, the downhole equipment is subject to abrasive and corrosive well fluids. This exposure greatly reduces the life of the equipment and creates the need for well repairs or intervention services.

All well reservoirs decline in production as the well reservoir is depleted. This depletion of product also lowers the pressure in the well's reservoir. As the pressure drops, the factors affecting artificial lift for the well change. Often, this change necessitates replacement of the artificial lift equipment and/or a change to the artificial lift process, and the well's production must be stopped until the equipment is replaced and/or the process is updated. The well's continuous change further complicates project planning and well design.

One way to avoid using down-hole equipment is single-point high-pressure gas injection ("SPHPG"). Unfortunately, the high-pressure gas in an SPHPG process pushes well debris into the producing formation to charge the pressure in the formation before the unloading process takes place, which causes the formation to be less productive.

It has been proposed to use LAGL to avoid using downhole equipment. For example, systems and processes for performing artificial lift on a well, including LAGL, are disclosed in U.S. Pub. No. 2021/0032965. Previous attempts to perform a LAGL process utilized a surface skid package having a liquid pump, a mixer, a gas conduit, a liquid conduit, and control equipment all mounted on a frame. Such a surface skid is mobile and can successfully move to and unload a well.

Often, a well pad site (as used herein, a well pad site refers to a cluster of two or more wells within three hundred yards of one another) will have multiple wells and a well field will have multiple well pad sites. Each well produces differently for a number of factors, which results in each well requiring different artificial lift schedules. As a result, the previous surface skid can only unload one well at a time because it can only output a single stream of a liquid and gas mixture to accommodate a single lift schedule. The cost to operate multiple surface skids on a well pad site becomes extremely expensive because of the high asset costs (e.g., the liquid pump and other equipment for each surface skid is very expensive).

SUMMARY

Described herein is a centralized compression and pumping system that controls the artificial lift process on multiple wells on an individual well basis as each well's characteristics require. The disclosed manifold system can start, stop, follow a schedule, and react to well conditions to make on-the-fly changes to the unloading process for the individual well it is in communication with. The system also may allow the operator to control each well manually if needed for intervention services, artificial lift or unloading. If one well needs to be shut in, the other well(s) can continuously operate without interruption. Moreover, the more expensive compression and pumping components can be shared with multiple wells and installed next to the storage tanks to lower asset costs.

BRIEF DESCRIPTION OF THE DRAWINGS

Illustrative embodiments of the present invention are described in detail below with reference to the attached drawing figures, wherein.

DETAILED DESCRIPTION

Figure 1:
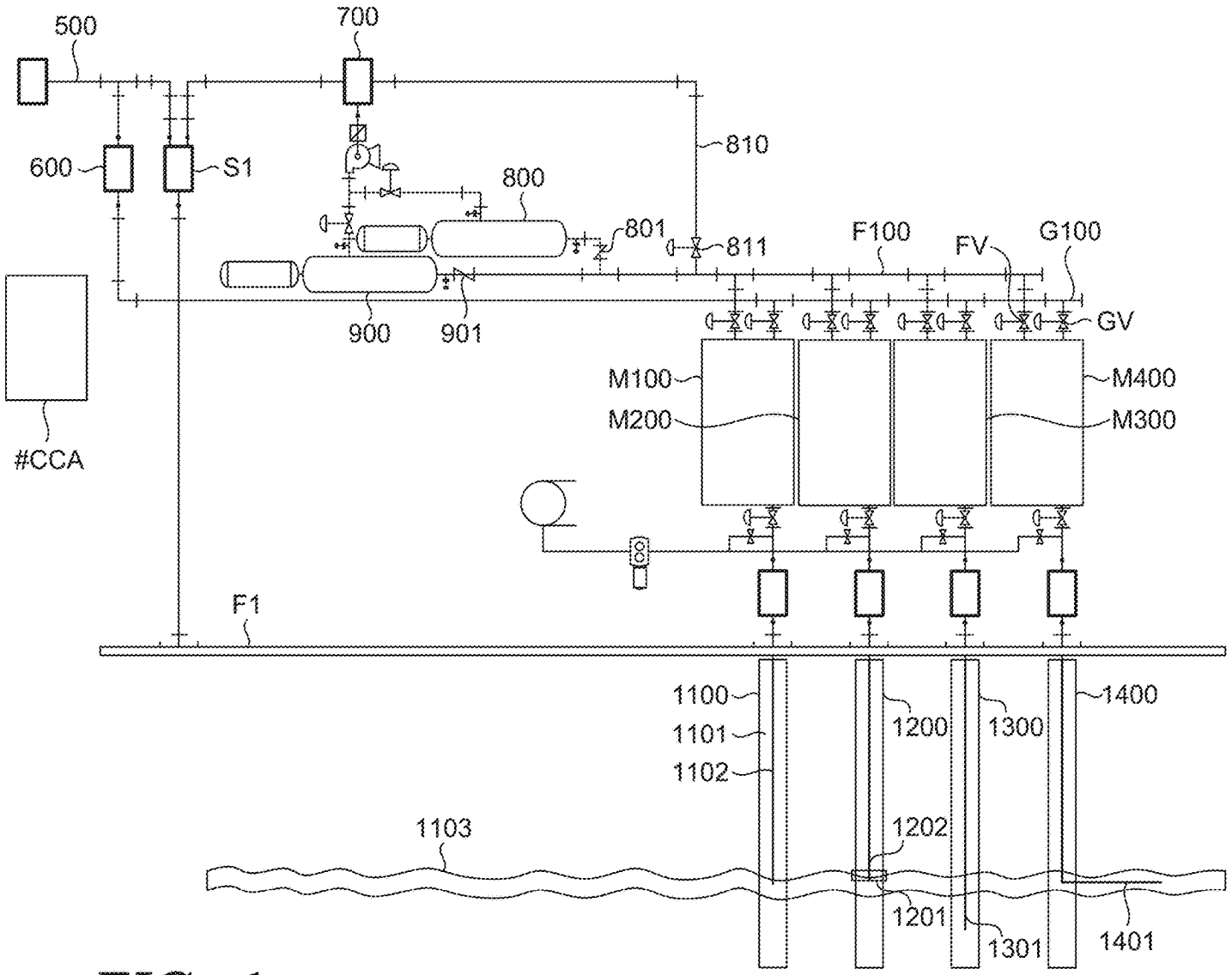
FIG. 1 depicts a well pad site having four wells and a system including centralized fluid and compression components for LAGL across each illustrated well simultaneously, in accordance with aspects described herein.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other present or future technologies. Further, it should be appreciated that the figures do not necessarily represent an all-inclusive representation of the embodiments herein and may have various components hidden to aid in the written description thereof.

At a high level, systems and processes for artificially lifting and/or unloading fluid from multiple wells with the same surface system, including simultaneously, is disclosed herein. An array of manifolds, each coupled to a well, may be supplied liquid and gas to create an individualized multiphase mixture injected into a respective well. The multiphase mixture may comprise a composition of liquid and gas based on individual well surface parameters and determined by an algorithm configured to optimize production on one well or a plurality of wells through a centralized compression and pumping facility. The composition of the multiphase mixture may change over time in response to changing well surface parameters through an iterative process.

A controlled-density fluid can be injected into a well from the surface using an artificial lift system. The artificial lift systems and processes described herein can utilize a mixture of a liquid and a gas for injecting into the well (e.g., LAGL). Without being bound by any particular theory, in certain aspects, the weight of the liquid in the mixture can carry the gas further down the well compared to conventional gas lift gas injection, and can provide for a deep-set injection into the tubing, thereby facilitating artificial lift. In such aspects, the relative amounts of the liquid and/or gas can be tailored in the mixture (i.e., the composition of the mixture may be varied) to facilitate an effective artificial lift process. For example, if too little liquid is present in the mixture, then there may be insufficient hydrostatic pressure to allow gas to be circulated to the tubing injection point. Further, in certain aspects, if an overabundance of liquid is present in the mixture, the time required to unload the liquid and kick off gas lift in the well significantly increases. In addition, in various aspects, the liquid injection rate can be tailored to create sufficient mixture velocity to carry gas bubbles downward to a deep-set valve.

In aspects, the liquid can include water, hydrocarbons, or a combination thereof. In aspects, the hydrocarbons can include crude oil. In the same or alternative aspects, the liquid can include crude oil produced from the well where the artificial lift process occurs.

In aspects, the gas can include hydrocarbons, air, or a combination thereof. In various aspects, the gas can include methane, ethane, propane, butane, air, or a combination thereof.

In aspects, the gas can be present in the mixture in an amount of from 10% volume of the mixture to 99% volume of the mixture. In other aspects, the gas can be present in the mixture in an amount of 30% volume of the mixture to 95% volume of the mixture. In still other aspects, the gas can be present in the mixture in an amount of 40% volume of the mixture to 85% volume of the mixture. The volume of the gas in the mixture refers to the mole fraction volume as determined at standard temperature and pressure.

Preferably, the well should be lifted with an underbalanced multiphase mixture without surfactants and other chemicals that cause surface separation production problems.

In some aspects, one or more chemical additives can be added to the liquid and gas mixture for one or more purposes. For instance, in one aspect, the chemical additives can include surfactants, de-emulsifiers, or other chemical additives known to have an impact on multiphase flow and the pattern of flow, such as impacting the transition from one flow pattern to another. In the same or alternative aspects, the chemical additives can include chemical additives that are known to reduce the required surface injection pressures in order to reduce the amount of fluid co-injected with the gas in the downward annular injection flow. In various aspects, the chemical additives can include chemical additives that are known to alter the flow in the production string downstream of the gas lift injection point and to alter the flow in horizontal and near-horizontal sections of pipe such as the horizontal well. In the same or alternative aspects, the chemical additives can include scale inhibitors and/or corrosion inhibitors. In aspects, the chemical additives can include chemical additives that are different than the liquid being utilized in the liquid and gas mixture.

As discussed above, in certain aspects, the relative amounts of the gas and liquid in the mixture and/or the flow rate of the mixture can be tailored to facilitate effective artificial lift. Additionally or alternatively, in certain aspects, the relative amounts of the gas and liquid in the mixture and/or the flow rate of the mixture can be tailored based on one or more of well geometry parameters, well productivity parameters, produced fluids properties, and surface production parameters. Certain well geometry parameters, well productivity parameters, produced fluids properties, and surface production parameters are described in: Brill, J. P., & Mukherjee, H. K. (1999) *Multiphase Flow in Wells*, Society of Petroleum Engineers, SPE Monograph Series Vol. 17, ISBN: 978-1-55563-080-5, the entirety of which is hereby incorporated by reference herein; and in Shoham, O. (2006) *Mechanistic Modeling of Gas-Liquid Two-Phase Flow in Pipes*, Society of Petroleum Engineers, ISBN 978-1-55563-107-9, the entirety of which is hereby incorporated by reference herein.

In various aspects, the well geometry parameters can include any physical parameters of the well or associated tubing, casings, or the like found in conventional oil wells. In aspects, a non-limiting list of well geometry parameters includes: an internal diameter of well tubing, an external diameter of well tubing, an internal diameter of a casing string, a depth of the casing string, an inclination of the casing string, a diameter of a vertical wellbore section, a depth of a vertical section, a depth of an injection valve, or a combination thereof.

In aspects, produced fluids properties can include any properties or parameters associated with fluids produced or extracted from the well. In aspects, a non-limiting list of produced fluids properties includes: a density of well-produced fluids, an American Petroleum Institute (API) gravity of well-produced fluids, such as an API gravity of oil or condensate, a viscosity of well-produced fluids, a pressure of well-produced fluids, a volume of well-produced fluids, a temperature of well-produced fluids, or a combination thereof.

In various aspects, well productivity parameters can include parameters and/or properties associated with productivity of the well. In certain aspects, a non-limiting list of well productivity parameters includes an average reservoir pressure, a flow potential for the well, recent production rates from the well, such as a 30-day average of an oil or condensate rate (e.g., in barrels per day), a 30-day average water rate (e.g., in barrels per day), a 30-day average gas rate (e.g., in thousand standard cubic feet per day (mscf/D)), a flowing tubing pressure, a well head pressure, a choke setting, a well head flowing temperature, or a combination thereof.

In aspects, surface production parameters can include properties and/or parameters associated with a gas source, a liquid source, or a mixture of the liquid and gas being injected into the well or to be injected into the well. In the same or alternative aspects, the surface production parameters can include well head or casing head properties. In aspects, a non-limiting list of the surface production parameters includes: a gas conduit pressure, a liquid conduit pressure, an injection point pressure, a liquid and gas mixture conduit pressure, an outlet pressure, a well head shut-in pressure, a well head shut-in temperature, a production line pressure, a separator pressure, a casing head shut-in temperature, a casing head shut-in pressure, a gas volume available or extractable from the gas source, a source gas pressure, or a combination thereof.

In aspects, the relative amounts of the gas and liquid in the mixture and/or the flow rate of the mixture can be tailored based on identifying one or more of: a diameter of the vertical wellbore section, a depth of the vertical section, a gas volume available or extractable from the gas source, a source gas pressure, an API gravity of produced fluids, such as an API gravity of oil or condensate, an oil or condensate average rate (e.g., in barrels per day), a water average rate (e.g., in barrels per day), a gas average rate (e.g., in mscf/D), and a flowing tubing pressure.

In certain aspects, liquid and/or gas injection or flow rates sufficient to facilitate downward bubble flow in the well can be determined based on one or more of the properties discussed above—e.g., the well geometry parameters, well productivity parameters, produced fluids properties, or surface production parameters. As discussed further below, in various aspects, downward bubble flow in the well can be facilitated in the tubing casing annulus of the well.

In various aspects, optimizing the liquid and/or gas flow rates may involve determining various properties associated with the well or the artificial lift system and/or specific control methods of the artificial lift system and processes disclosed herein. For instance, in aspects, one or more of the following may be performed to aid in tailoring a flow rate of a liquid and a gas to achieve artificial lift and/or maintain artificial lift: calculating a flow rate sufficient to facilitate downward bubble flow in a tubing casing annulus; calculating a minimum liquid weight required to achieve circulation of gas into tubing in light of a source gas pressure; calculating a (gas) bubble rise velocity at multiple points in the tubing casing annulus; calculating one or more fluid level(s) in the casing or tubing in order to assign various flow regimes; and tailoring a flow of the liquid and/or the gas to provide various patterns of high and/or low liquid injection rates. The determination of one or more of these parameters is further discussed below.

A multiphase flow correlation and/or model can be used for downward multiphase flow, such as, but not limited to, the Beggs & Brill correlation shown in equation (1) below. In such aspects, this correlation can aid in determining liquid and gas injection rates at the surface required to achieve downward bubble flow in the tubing-casing annulus. In such aspects, a minimum liquid velocity must be achieved for injected gas to move downward.

$$F_{DRAG} \geq F_{BUOYANCY} \tag{1}$$

In aspects, where chemical additives, such as the chemical additives discussed above are utilized, a homogeneous flow model may be utilized to determine both frictional and gravitational pressure changes in the annulus of the well using the formulas of equations (2), (3), (4), and (5) below. This flow model may be utilized to aid in determining the liquid and gas injection rates at the surface required to achieve downward bubble flow in the tubing-casing annulus.

$$\left(\frac{dP}{dx}\right)_{Gravitational} = \rho_m \frac{g}{g_c} \sin\theta \tag{2}$$

-continued $$\left(\frac{dP}{dx}\right)_{Frictional} = \frac{f_m \rho_m v_m^2}{2 g_c d} \tag{3}$$

$$\rho_m = \rho_L \lambda_L + \rho_G (1 - \lambda_L) \tag{4}$$

$$\lambda_L = \frac{Q_L}{Q_L + Q_G} \tag{5}$$

$Q_L$ is the liquid volumetric flow rate at in-situ conditions, $Q_G$ is the gas volumetric flow rate at in-situ conditions, g is the acceleration of gravity, $g_c$ is the gravitational constant, $\theta$ is the inclination of the pipe, $f_m$ is the mixture friction factor, $v_m$ is the velocity of the two-phase mixture at in-situ conditions, d is the diameter of the pipe, XL is the no-slip liquid holdup, $\rho_L$ is in-situ liquid density, $\rho_G$ is the in-situ gas density and $\rho_m$ is the in-situ mixture density. In aspects, in-situ conditions refers to conditions during operation of the processes disclosed herein.

In one or more aspects as discussed above, a fluid level in the casing/tubing can be determined and one or more flow regimes can be assigned for use. In such aspects, flow modeling can be done for the various regimes of the pipe which may be present in the well at startup which may be assigned single-phase gas, single-phase liquid, and multiphase (e.g., gas and liquid) designations. This may be done by comparing shut-in wellhead pressures with estimated reservoir pressure, for instance as with equation (6) below.

$$P_{CHSI} = P_{res} - \bar{\rho}_L [D_{bh} - D_{LL}] - \bar{\rho}_G [D_{LL}] \tag{6}$$

$P_{CHSI}$ is the casing head shut-in pressure, $P_{res}$ is the average reservoir pressure or an approximation of the buttonhole pressure at shut-in conditions just prior to starting the artificial lift procedure, $\rho_L$ is liquid density, $\rho_G$ is gas density, $D_{bh}$ is the total vertical depth to the reservoir perforations or intake point, and $D_{LL}$ is the depth to the liquid level in the tubing-casing annulus.

In one or more aspects, utilizing one or more of the well geometry parameters, well productivity parameters, produced fluids properties, or surface production parameters, one can determine a gas bubble rise velocity at one or more points in the tubing-casing annulus to ensure that the gas will move downward in the tubing-casing annulus to a deep-set valve. In such aspects, the gas bubble rise velocities can be utilized to determine flow or injection rates of the liquid and gas mixture to create suitable conditions for downward movement of the gas.

In aspects, based on one or more of the well geometry parameters, well productivity parameters, produced fluids properties, and surface production parameters, one can identify flow patterns for the liquid, gas, or mixture thereof to create a specific environment in the tubing-casing annulus for downward movement of the injected gas such that the bubble rise velocity is exceeded by the downward velocity of the liquid and gas mixture. In other words, the relative amounts of gas and liquid injected are important to establish the proper downward multiphase flow pattern to both create the proper hydrostatic pressure, or weight, and achieve a velocity and flow pattern for downward flow of the gas-liquid mixture.

Above, various determinations are described that generally may be associated with the tailoring of the liquid and/or gas flow rate to achieve downward movement of the gas and, e.g., into the production tubing. In various aspects, one or more of the tubing head pressure, tubing head temperature, casing head pressure, and casing head temperature may be monitored to modify the injected gas and liquid rates to ensure the gas is circulated through the deep-set valve or around the bottom of the tubing if no valve is used. In such aspects, if casing head pressures increase beyond an expected threshold, additional liquid can be injected to add "weight" to keep below the maximum gas source pressure. Further, in such aspects, iterations may be performed between the injection flow pattern calculations and the integrated "weight" history injected during the kick-off process.

In certain aspects discussed above, it may be desirable to minimize the use of the liquid being injected into the well. For instance, in certain aspects, the liquid injection rate may be initially high in order to facilitate downward movement of the gas; however, once the gas enters the production tubing, it may be desirable to reduce the injection rate of the liquid. In aspects, prior to changing the liquid flow rate, gas entry into the tubing may be detected through monitoring one or more parameters, such as the tubing head pressure and temperature. For instance, an increase in flowing tubing head pressure may indicate a drop in density of fluids in the tubing string caused by the entry of gas. In the same or alternative aspects, the multiphase flow calculations and the monitoring of the casing head pressure may be utilized to detect or determine gas entry into the tubing. For example, a decrease in injection casing head pressure may indicate a drop in density of fluids in the tubing string caused by the entry of gas, multiphase flow velocities can be utilized to determine the time when gas reaches the valve or end-of-tubing if no valve is used, and/or multiphase flow correlations can be utilized to determine the pressure at the injection point by calculating upward flow in the tubing utilizing the measured wellhead tubing flowing pressure.

In aspects, once the gas enters the tubing, the liquid injection rate may be reduced. In such aspects, the reduction (or ramping down) in liquid injection rates can be performed in part by monitoring both the wellhead tubing and casing pressures so that the appropriate parameters are present to maintain gas entry in the production tubing. Further, in such aspects, a non-limiting list of methods for ramping down the liquid injection rate while maintaining gas entry into the tubing includes: iterating the weight of the fluid column with the wellhead tubing and casing pressures to maintain injection at the downhole injection point; utilizing multiphase flow correlations to predict the pressure at the gas injection point in the tubing (either at the single deep-set valve or at the end of the tubing) and iterating the downward flow calculation to match the input flowing tubing head pressure and casing head injection pressure; and/or switching the liquid rates from high to low levels to create slugs of single-phase liquid, bubble or slug/churn flow that travels downward separated by gas bubbles.

By controlling the injection rates of gas and liquid, the density of the mixture can be controlled and the well fluids can be unloaded with underbalanced pressure.

By using a computer-controlled programmable logic controller (PLC) manifold mixing system on each well and a centralized gas and fluid pressure system, the system injection can optimize well production across multiple wells.

FIG. 1 depicts a four-well pad location with each well controlled independently by manifolds M100, M200, M300, and M400. In this exemplary embodiment, the four wells extend to a depth of 10,000' and the production formation 1103 is located at a depth of 9500'. As an example, the first, second, third, and/or fourth well bores 1100, 1200, 1300, 1400 can comprise 5½" casing and/or open-end 2⅞" production tubing (e.g., 1102). In this case, the multiphase fluid may be injected from the manifold into the annulus area between the production tubing and the casing (e.g., 1101) and return up the production tubing and out of the well through the flow line F1 to the separator S1. In other aspects, the multiphase fluid may be injected from the manifold into the production tubing 1102 and return up through the annulus area 1101 and out of the well through the flow line F1 to the separator S1.

The second well 1200 in FIG. 1 is shown as additionally comprising a packer 1201. In this case, the injection multiphase fluid may be injected from the manifold into the annulus area between the production tubing and the casing, then into the tubing through a perforated hole in the tubing just above the packer (e.g., at location 1202) and return up the production tubing and out of the well through the flow line F1 to the separator S1.

The third well 1300 in FIG. 1 depicts production tubing 1301 extending below the formation 1103. In this case, the multiphase fluid may be injected from the manifold into the annulus area between the production tubing and the casing, then return up the production tubing and out of the well through the flow line F1 to the separator S1.

The fourth well 1400 in FIG. 1 depicts production tubing 1401 extending into a lateral section of the well. In this case, the multiphase fluid may be injected from the manifold into the annulus area between the production tubing and the casing, then return up the production tubing and out of the well through the flow line F1 to the separator S1.

In the four wells depicted in FIG. 1, the injection from the manifold can be down the annulus and up the tubing or down the tubing and up the annulus. Each of these wells would have a different injection program for unloading the well.

FIG. 1 additionally illustrates a possible layout for the centralized system. The supply gas comes from the gas sales line 500 and the fluid may come from a fluid storage tank 700. The gas sales line 500 feeds gas into the compressor 600, which compresses the gas to the required pressure and delivers the gas to the manifolds M100, M200, M300, and M400. The fluid tank 700 supplies the fluid to pumps 800 and 900 then pressurizes the fluid to the required field pressure and delivers the fluid to each manifold. Back pressure valves 801 and 901 are installed in the fluid line to protect the pumps. A recirculation line 810 is attached to a control valve 811 that allows unused fluid to flow back to the fluid storage tank(s). The gas flows through pressure line G100 to the manifold block valve for gas GV and the fluid flows through the pressure fluid line F100 to the manifold block valve for fluid FV.

Figure 2:
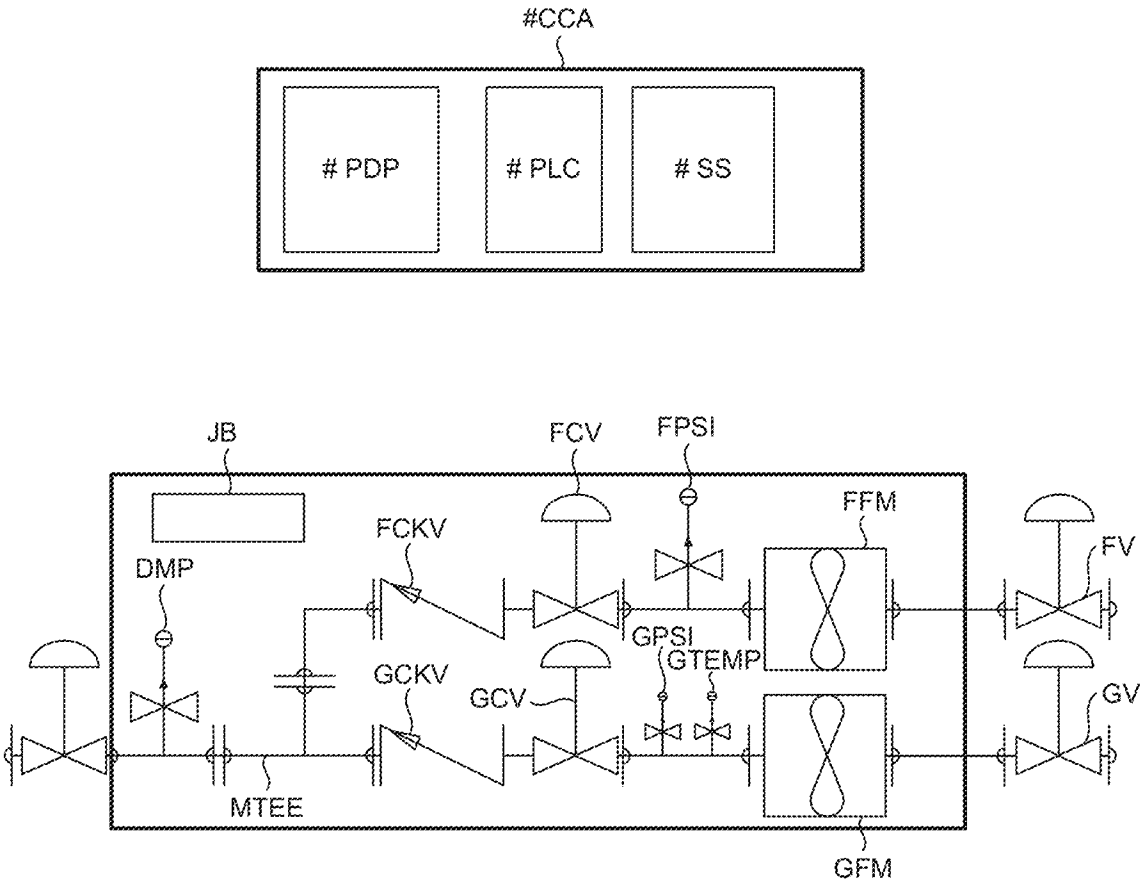
FIG. 2 depicts a schematic of a manifold configured to control a LAGL injection into an associated well, in accordance with aspects described herein.

FIG. 2 illustrates an exemplary manifold. Pressurized fluid enters the manifold through fluid block valve FV and gas enters through gas block valve GV. The fluid flows through the fluid meter FFM then through the pressure transmitter FPSI to the control valve FCV and out through the fluid check valve FCKV. The gas travels through the gas flow meter GFM and through the gas temperature transmitter GTEMP and gas pressure transmitter GPSI. The gas then moves through the gas control valve GCV and into the gas check valve GCKV. At this point, the needed volume and pressure of gas and fluid moves to the mixing tee MTEE where the correct multiphase mixture flows to the well. A manifold pressure sensor DMP measures the manifold pressure, and a block valve MDBV at the exit point of the manifold is used to shut in and isolate each manifold if required.

The manifold meters, transmitters, control valve, and mixing tee are all monitored and controlled through the central control assembly CCA then relayed to the manifold junction box JB. The central control assembly comprises a power distribution panel PDP, a starting system SS, and the programmable logic controller PLC. In the control box is a central processing unit (CPU), I/O ports, a display panel, a memory card, and a modem.

Well geometry is entered into the flow model for each well, and the output is programmed into the PLC.

After the system is in place and programmed, the unit can self-start from feedback on each well's pressure sensor, or the unit can be manually started. The unit will then start the fluid pumps and gas compression. The control valves will start to open and allow the programmed amount of fluid rate into the well. After the fluid has started to flow into the well, the gas control valve will slowly add the gas according to the schedule requirements for each well. As the well pressure changes, the fluid gas mixture will change gradually, allowing more gas into the flow stream. The pressure will slowly increase until the well starts to unload. At this point, the pressure will start to drop, letting the program know to start decreasing the fluid injection. This process will continue for each well and make corrections to the fluid and/or gas rate(s) as needed until the well is flowing product. Using this process, the system operates each well autonomously and shuts down the system when the process is complete according to feedback from the well's flow rate and pressure transmitter.

Figure 3:
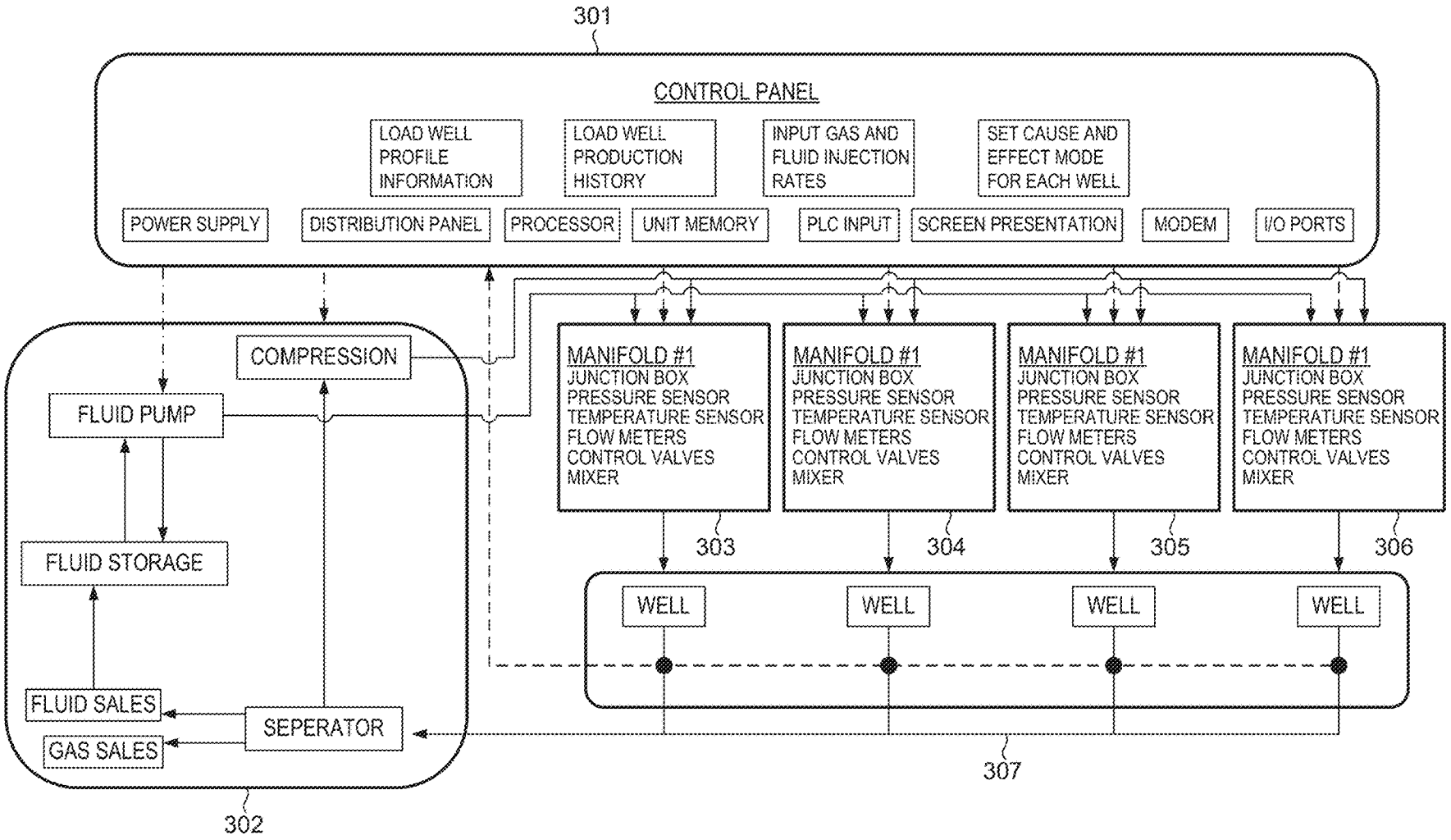
FIG. 3 depicts a schematic of the well pad site and system of FIG. 1, in accordance with aspects described herein.

FIG. 3 illustrates a flow diagram for the LAGL unload process. There are four major components to the system: the control panel 301, the central facilities 302, the manifolds 303-306, and the wells 307. The process is controlled by the control panel 301, where the process is planned and communicated to the central facilities and manifolds. Feedback travels through the communication line from the central facility, and manifolds and wells give the control panel the information needed to complete the process and make changes to the multiphase input during the process to maximize well production.

Figure 4:
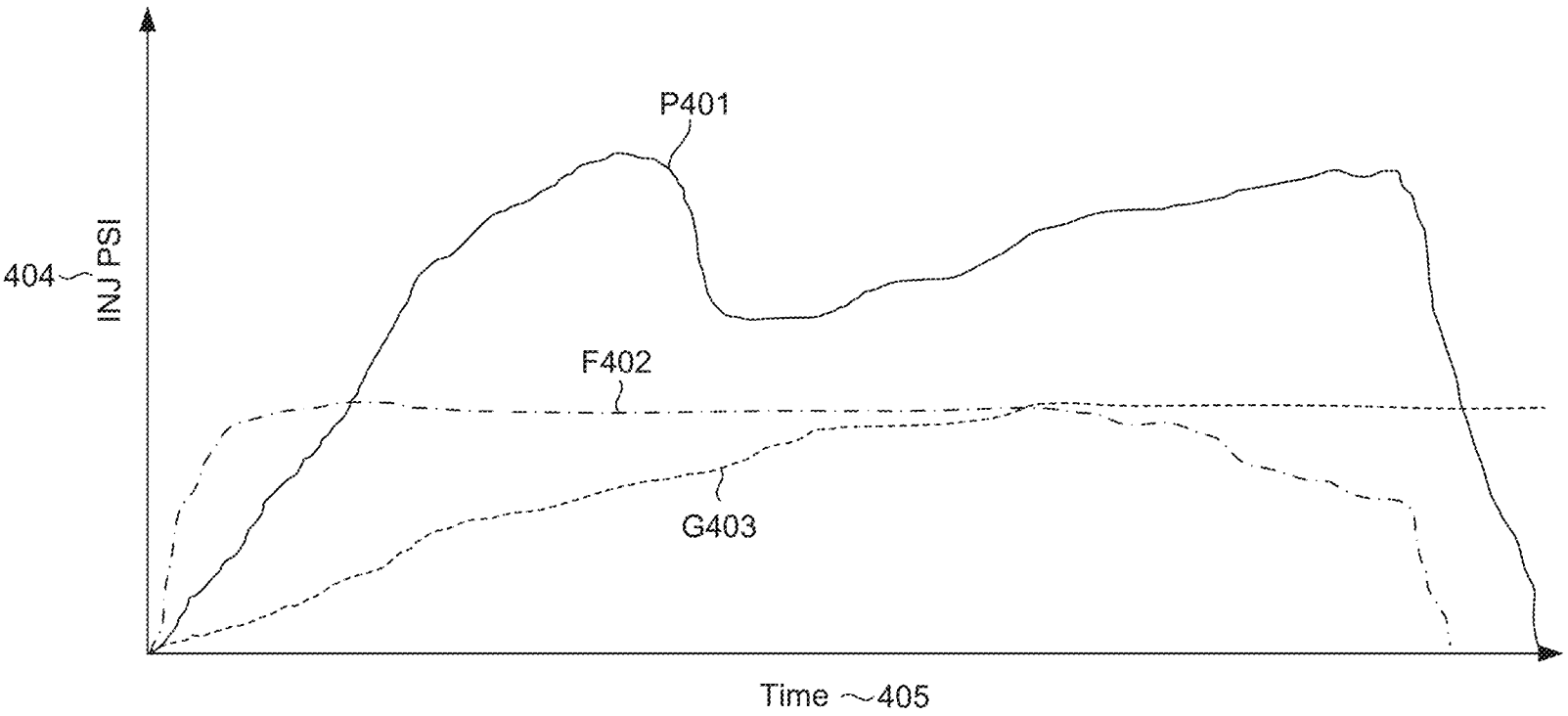
FIG. 4 depicts a pumping schedule for a first well, in accordance with aspects described herein.

FIG. 4 illustrates an exemplary graph of gas and fluid rates for a well where the Y axis 404 represents pressure and the X axis 405 represents time; P401 represents well pressure. The fluid rate F402 increases and is steady until the gas rate G403 reaches its peak. At this point the gas is returning to the surface and expanding, and the fluid is unloading from the well. As the well is unloading the fluid rate starts to decrease and eventually shut off while the fluid exits the well.

Figure 5:
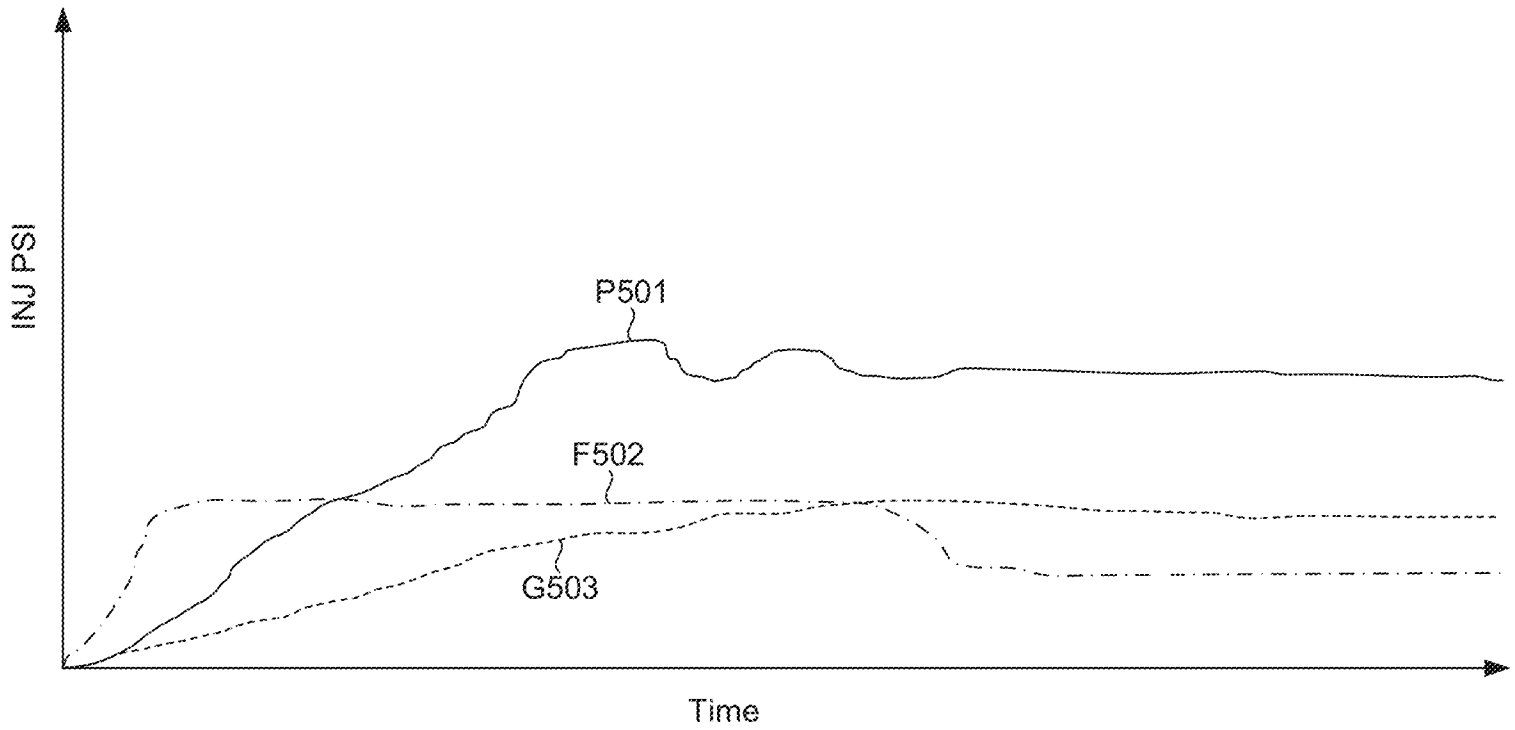
FIG. 5 depicts a pumping schedule for a second well, in accordance with aspects described herein.

FIG. 5 illustrates another exemplary graph of gas and fluid rates for a well where the Y axis represents pressure and the X axis represents time; G503 represents the gas rate. In this instance, the well pressure P501 reacts differently than in FIG. 4, causing the fluid rate F502 to stay at a high rate to keep the well pressure P501 lower. Later, the fluid rate will be decreased again to see if the pressure will drop so the cycle can be completed. If the manifold fails to change the liquid and/or gas rates in response to the well changing pressure, the pressure can become too great and the system can fail.

Figure 6:
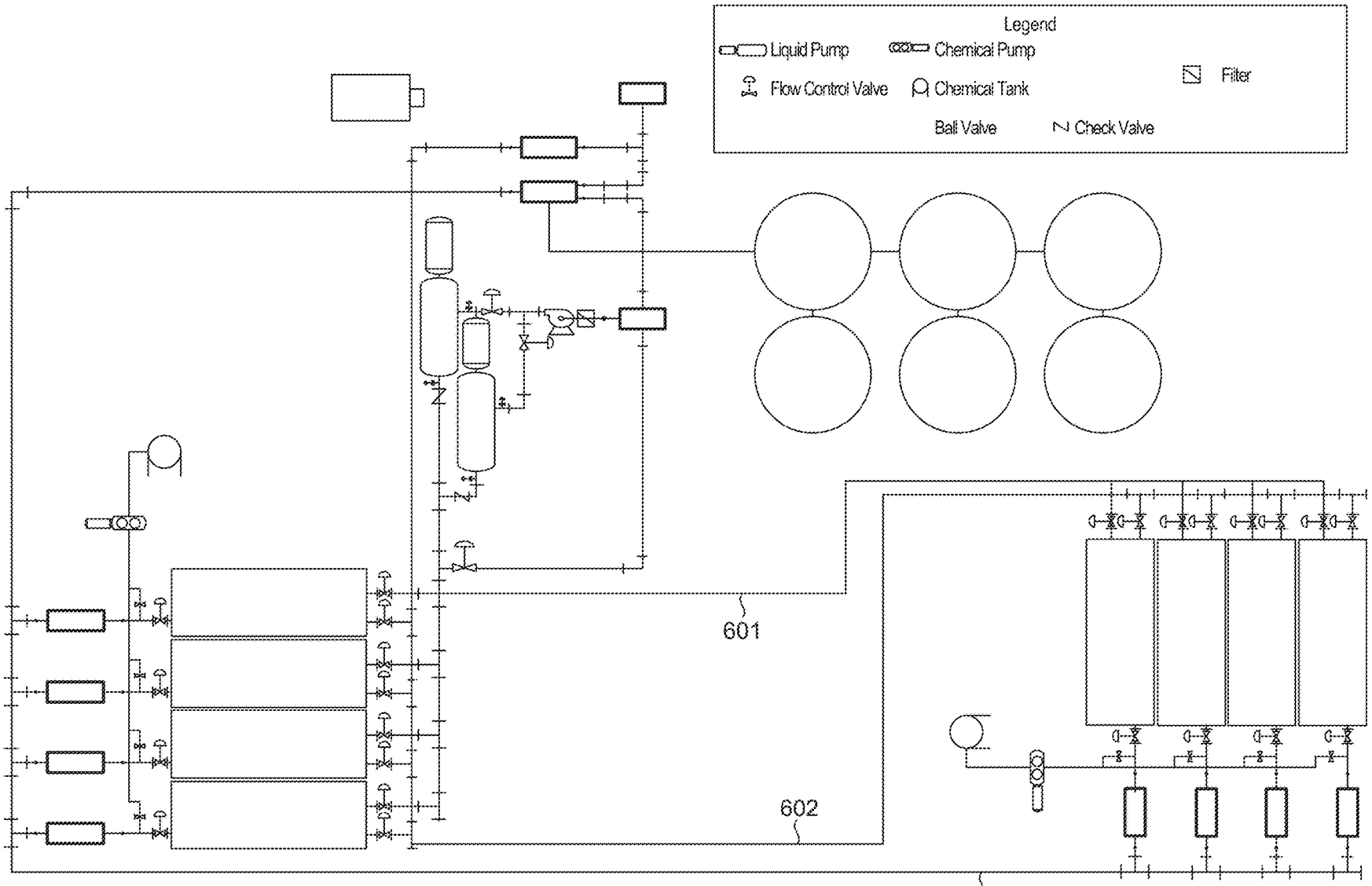
FIG. 6 depicts a well field having two well pad sites and a system including centralized fluid and compression components for LAGL across each illustrated well simultaneously, in accordance with aspects described herein.

FIG. 6 illustrates an LAGL system with eight wells on two well pad sites. The changes that need to be made (i.e., relative to the four-well system illustrated in FIG. 1) include adjusting the sizing the fluid pumps and compressor and the addition of extension lines 601 and 602, which are extensions of the fluid and gas injection lines, respectfully, to the additional manifolds, and addition of the extension line 603, which is the return line for the additional four wells, to the first four-well return line.

Figure 7:
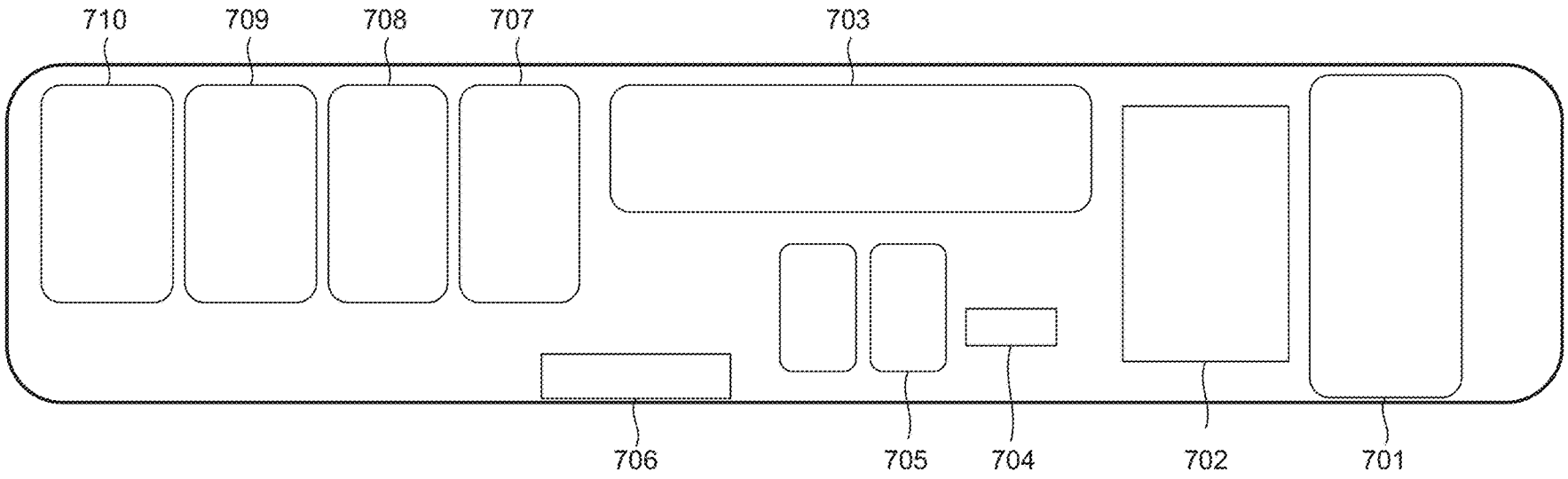
FIG. 7 depicts a schematic of an exemplary trailer-mounted system comprising four manifolds.

FIG. 7 depicts an aspect of a trailer-mounted system where the manifolds are carried together rather than being mounting to or near a respective well being unloaded. The manifolds here may each be in communication with a separate well on a well pad site and configured for injecting multiphase fluid for a LAGL process on the separate well. This configuration can be easily moved from one location to another. This arrangement can be controlled by the central control unit 706. The central facility equipment, compressor 701, booster 702, fluid pump 703, and chemical addition pump 704 with chemical tanks 705 can be mounted to the rear of the unit allowing for the manifolds 707-710 to be mounted to the front.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

We claim:

1. A system for injecting a mixture of a liquid and a gas into a plurality of wells, comprising:

a first manifold coupled to: (a) a first valve in fluid communication with a gas line and (b) a second valve in fluid communication with a liquid line, wherein the first manifold is operatively configured to generate a first mixture of the liquid and the gas and communicate the first mixture to a first well;

a second manifold coupled to: (a) a third valve in fluid communication with the gas line and (b) a fourth valve in fluid communication with the liquid line, wherein the second manifold is operatively configured to generate a second mixture of the liquid and the gas and communicate the second mixture to a second well;

a pump configured to communicate the liquid to the first manifold and the second manifold via the liquid line; and a computing device configured to:

receive pressure data associated with the first well;

receive pressure data associated with the second well;

based on the pressure data associated with the first well, instruct operation of at least one of the first valve and the second valve to set a composition of the first mixture; and based on the pressure data associated with the second well, instruct operation of at least one of the third valve and the fourth valve to set a composition of the second mixture.

2. The system of claim 1, wherein the liquid comprises crude oil.

3. The system of claim 1, wherein the gas comprises methane.

4. The system of claim 1, wherein the computing device is further configured to:

receive additional pressure data associated with the first well;

determine, based on the additional pressure data, a target composition of the first mixture; and instruct operation of at least one of the first valve and the second valve such that the first mixture reaches the target composition.

5. The system of claim 1, wherein the computing device is further configured to:

receive flow rate data associated with the first well; and based on the flow rate data, instruct the system to shut down.

6. The system of claim 1, wherein the computing device is further configured to:

determine that a casing head pressure associated with the first mixture exceeds a threshold; and based on the determination that the casing head pressure exceeds the threshold, instruct operation of the second valve such that a concentration of the liquid in the first mixture is increased.

7. The system of claim 1, wherein the system further comprises a compressor coupled to the gas line.

8. A manifold for injecting a mixture of a liquid and a gas into a well, the manifold comprising:

a first inlet coupled to a first valve in fluid communication with a gas line, the gas line comprising the gas;

a second inlet coupled to a second valve in fluid communication with a liquid line, wherein the liquid line is coupled to a pump operably configured to communicate the liquid to the manifold;

a receiver operably configured to receive, from one or more sensors associated with the well, pressure data from the well;

the receiver further operably configured to receive an instruction to operate at least one of the first valve and the second valve to set a composition of the mixture, wherein the control device is operably configured to transmit the instruction to the receiver based on the pressure data associated with the well; and an outlet operably configured to deliver the mixture to the well.

9. The manifold of claim 8, wherein the liquid comprises crude oil.

10. The manifold of claim 8, wherein the gas comprises methane.

11. A computer-implemented method comprising:

instructing a pump to communicate a liquid to a first manifold associated with a first well and a second manifold associated with a second well, wherein the first manifold is coupled to a first valve configured to control a first flow rate of the liquid into the first manifold, and wherein the second manifold is coupled to a second valve configured to control a second flow rate of the liquid into the second manifold;

receiving a first indication of a decrease in pressure associated with the first well;

based on the first indication, instructing operation of the first valve such that the first flow rate is decreased;

receiving a second indication of a decrease in pressure associated with the second well; and based on the second indication, instructing operation of the second valve such that the second flow rate is decreased.

12. The computer-implemented method of claim 11, further comprising:

based on the first indication, instructing operation of a third valve coupled to the first manifold to change a third flow rate of a gas into the first manifold; and based on the second indication, instructing operation of a fourth valve coupled to the second manifold to change a fourth flow rate of a gas into the second manifold.

13. The computer-implemented method of claim 12, wherein the gas is supplied to the first manifold and the second manifold by a first gas line.

14. The computer-implemented method of claim 12, wherein the first manifold is configured to generate a first mixture of the liquid and the gas, and wherein the second manifold is configured to generate a second mixture of the liquid and the gas.

15. The computer-implemented method of claim 14, wherein the first manifold is configured to communicate the first mixture to the first well, and wherein the second manifold is configured to communicate the second mixture to the second well.

16. The computer-implemented method of claim 15, wherein the method further comprises calculating an updated flow rate sufficient to facilitate downward bubble flow into the first well, and wherein the third flow rate is changed to the updated flow rate.

17. The computer-implemented method of claim 16, wherein the calculating is based on one or more of: geometry parameters of the first well, productivity parameters of the first well, produced fluids properties of the first well, and surface production parameters of the first well.

18. The computer-implemented method of claim 14, further comprising:

receiving additional pressure data associated with the first well;

determining, based on the additional pressure data, a target composition of the first mixture; and instructing operation of at least one of the first valve and the third valve such that the first mixture reaches the target composition.

19. The computer-implemented method of claim 12, wherein the gas comprises methane.

20. The computer-implemented method of claim 11, wherein the liquid comprises crude oil.

* * * * *